US007235752B1

(12) United States Patent
Chen et al.

(10) Patent No.: US 7,235,752 B1
(45) Date of Patent: Jun. 26, 2007

(54) ILLUMINATING MEMBRANE SWITCH AND ILLUMINATING KEYPAD USING THE SAME

(75) Inventors: Ching Hsiang Chen, Yonghe (TW); Shaw Jong Wang, Jhubei (TW); Cheng Chong Chen, Gueishan Township, Taoyuan County (TW); Heng Bao Lai, Taipei (TW)

(73) Assignee: RILITE Corporation, Hsinchu County (TW)

( * ) Notice: Subject to any disclaimer, the term of this patent is extended or adjusted under 35 U.S.C. 154(b) by 0 days.

(21) Appl. No.: 11/463,220

(22) Filed: Aug. 8, 2006

(30) Foreign Application Priority Data

Jan. 2, 2006 (TW) ..... 95200025 U

(51) Int. Cl.
*H01H 9/20* (2006.01)

(52) U.S. Cl. ..... 200/310; 200/314; 200/317

(58) Field of Classification Search ..... 200/5 A, 200/512, 517, 310, 313, 314, 317, 344; 341/22; 345/168–170
See application file for complete search history.

(56) References Cited

U.S. PATENT DOCUMENTS 6,100,478 A * 8/2000 LaPointe et al. ..... 200/314
6,179,432 B1 1/2001 Zhang et al.
6,198,060 B1 * 3/2001 Yamazaki et al. ..... 200/305
6,545,232 B1 * 4/2003 Huo-Lu ..... 200/5 A
6,554,442 B2 * 4/2003 Chou ..... 362/85
6,686,549 B2 * 2/2004 Douzono et al. ..... 200/341
6,743,993 B1 * 6/2004 Clark et al. ..... 200/314
6,860,612 B2 * 3/2005 Chiang et al. ..... 362/29
7,057,125 B1 * 6/2006 Tsai ..... 200/310
7,071,433 B2 * 7/2006 Holscher ..... 200/310

* cited by examiner

*Primary Examiner*—Michael A. Friedhofer
(74) *Attorney, Agent, or Firm*—Egbert Law Offices

(57) ABSTRACT

An illuminating membrane switch includes an upper membrane sheet and a lower membrane sheet. The lower membrane sheet includes an electroluminescent device and a plurality of lower lead wires disposed on the illuminating surface of the electroluminescent device. An insulating spacer layer is further disposed on the illuminating surface of the electroluminescent device, and separates the upper lead wires of the upper membrane sheet from the lower lead wire. When a pressing force acting on the illuminating membrane is sufficient, the upper lead wire and the lower lead wire at the pressing position can contact each other through the opening of the insulating spacer layer so as to form a closed circuit. The keyboard can light up the symbols on the surfaces of key caps by light emitted from the illuminating membrane for a user to identify the function or alphabetic input of each key cap, and detect any input from a keystroke.

12 Claims, 6 Drawing Sheets

ILLUMINATING MEMBRANE SWITCH AND ILLUMINATING KEYPAD USING THE SAME

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to an illuminating membrane switch and an illuminating keypad or keyboard using the same, more particularly to a membrane switch capable of emitting rays to highlight alphanumeric symbols on keys and detecting any keystroke.

BACKGROUND OF THE INVENTION

When working in a condition with low light or even no light, a user cannot see the alphanumeric symbols on the keys of a keyboard clearly, for example, when a notebook computer is used on airplanes, or when a keyboard attached to equipment is used in a lithography laboratory.

FIG. 1 is an upper view diagram of an illuminating keyboard disclosed in U.S. Pat. No. 6,179,432. The keyboard 10 has a plurality of key caps 11 mounted on a housing 15 and is allowed to have finite downward displacement along its vertical direction. There is a symbol 12 printed on the surface of each of the key caps 11 to illustrate the function of the corresponding one, for example, numeric input keys 0–9, alphabetic input keys A–Z and function keys F1–F12. An electroluminescent device 13 is placed under the key caps 11, and is driven to illuminate by an AC source. Therefore, the 3.3V or 5V DC power supplied by a cable 14 needs to be converted into the specific AC power so as to meet the requirement of the electroluminescent device 13.

FIG. 2 is an exploded diagram of the illuminating keyboard in FIG. 1. The electroluminescent device 13 comprises a plurality of openings 131, each of which is aligned with the corresponding key cap 11 above. Moreover, a driving circuit 133 converts the 3.3V or 5V DC power supplied by a cable 14 into the specific AC power so as to meet the specification of the electroluminescent device 13. An elastomer layer 21 made from rubber or silicone is placed beneath the electroluminescent device 13, and has a plurality of key actuators 211 whose positions correspond to the positions of the key caps 12. Because the key actuator 211 is very flexible, it can rapidly return to its original shape after a keystroke is released. When the key actuator 211 is deformed after the pressing of the key cap 12, a membrane switch 22 beneath the elastomer layer 21 is switched on, and meanwhile an input signal corresponding to the key cap 12 is transmitted to a host through the cable 14.

Because the electroluminescent device 13 is placed beneath the key cap 12, the structure of the key cap 12 needs to be redesigned to hold the thickness of the electroluminescent device 13. On the other hand, the deformed movement is still necessary for the key actuator 211, and hence the total thickness of the key cap 12 is increased and the design of the keyboard structure becomes difficult.

BRIEF SUMMARY OF THE INVENTION

The primary objective of the present invention is to provide a thin illuminating membrane switch. Compared with a conventional illuminating keyboard and a conventional illuminating membrane switch, the present invention uses less constituting materials and reduces the whole thickness, and provides an illuminating membrane switch for a keyboard to detect any input from a keystroke. The illuminating membrane switch also emits rays through key caps to light up the symbols printed on the key caps' surfaces when the keyboard is powered.

The second objective of the present invention is to provide a backlight membrane switch acceptable for the structure of a conventional keyboard. The housing, key caps and key actuators of the conventional keyboard do not need to be re-designed.

In order to achieve the objective, the present invention discloses an illuminating membrane switch and illuminating keyboard using the same. The illuminating membrane switch comprises an upper membrane sheet and a lower membrane sheet. The lower membrane sheet includes an electroluminescent device and a plurality of lower lead wires disposed on the illuminating surface of the electroluminescent device. An insulating spacer layer is further disposed on the illuminating surface of the electroluminescent device, and separates the upper lead wires of the upper membrane sheet from the lower lead wire. When a pressing force acting on the illuminating membrane is sufficient, the upper lead wire and the lower lead wire at the pressing position can contact each other through the opening of the insulating spacer layer so as to form a closed circuit. The keyboard can light up the symbols on the surfaces of key caps by light emitted from the illuminating membrane for a user to identify the function or alphabetic input of each key cap, and can detect any input from a keystroke.

BRIEF DESCRIPTION OF THE SEVERAL VIEWS OF THE DRAWINGS

The invention will be described according to the appended drawings.

DETAILED DESCRIPTION OF THE INVENTION

Figure 1:
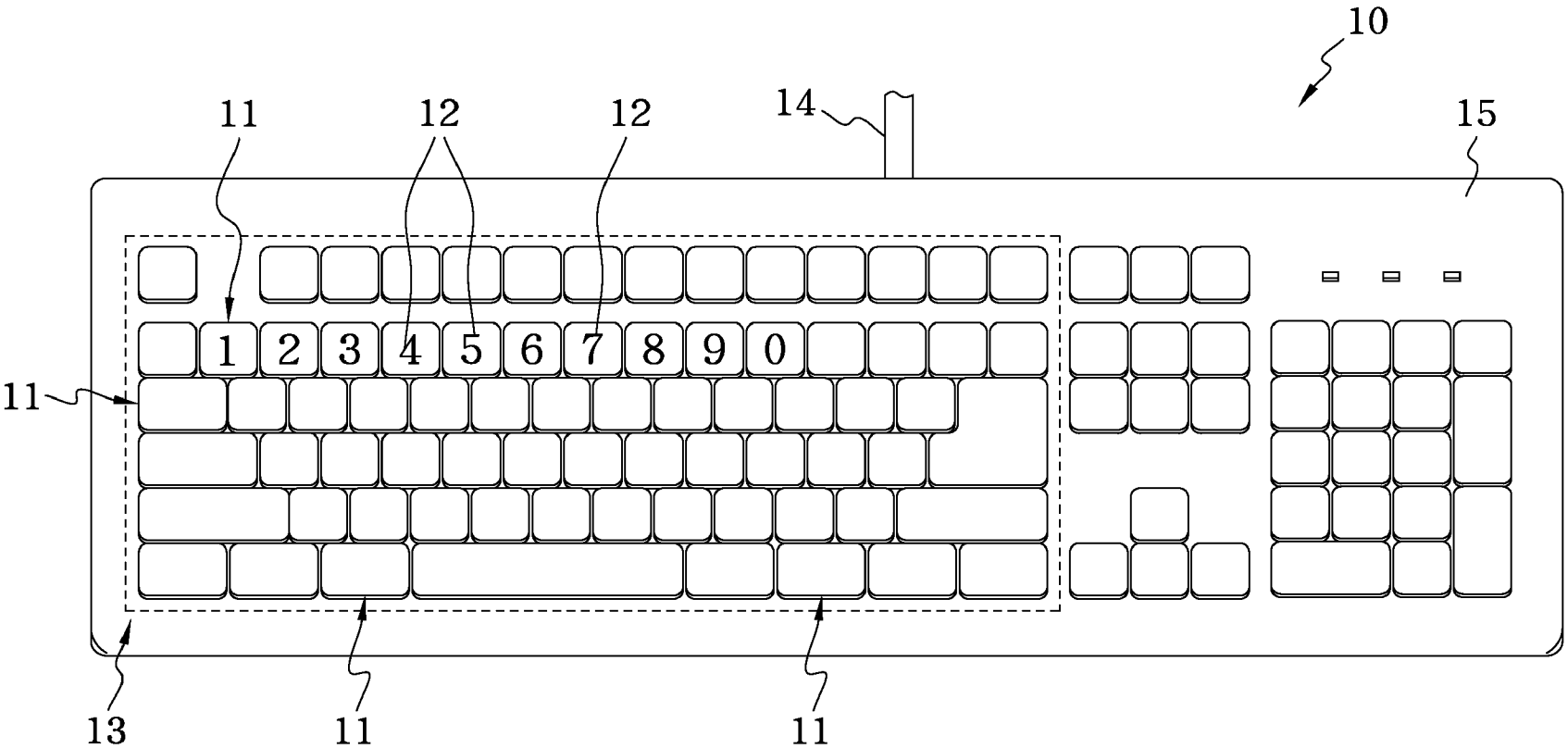
FIG. 1 (Prior Art)
FIG. 1 is a top plan view of an illuminating keyboard disclosed in U.S. Pat. No. 6,179,432.
Figure 2:
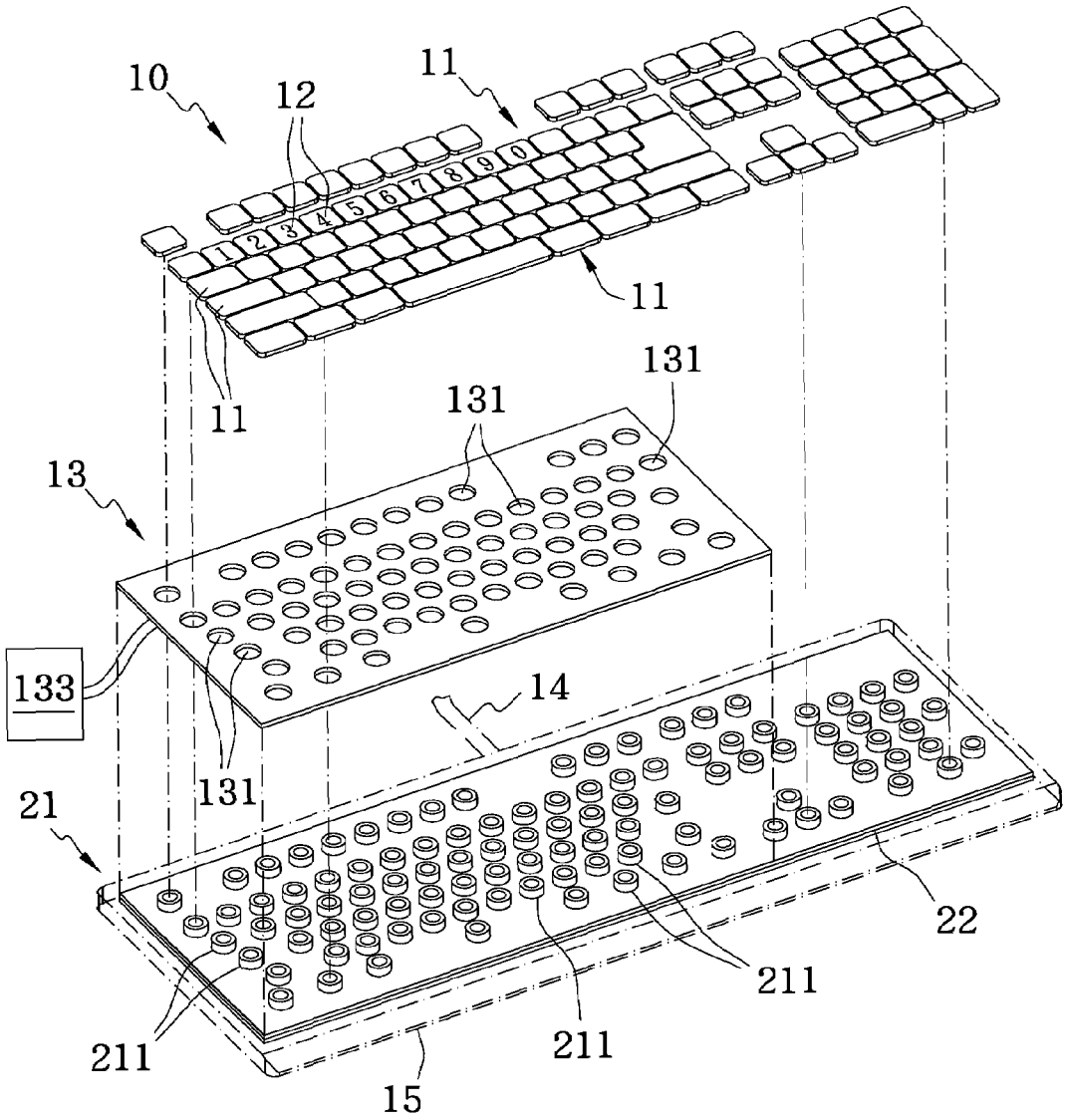
FIG. 2 (Prior Art)
FIG. 2 is an exploded perspective view of the illuminating keyboard in FIG. 1.
Figure 3:
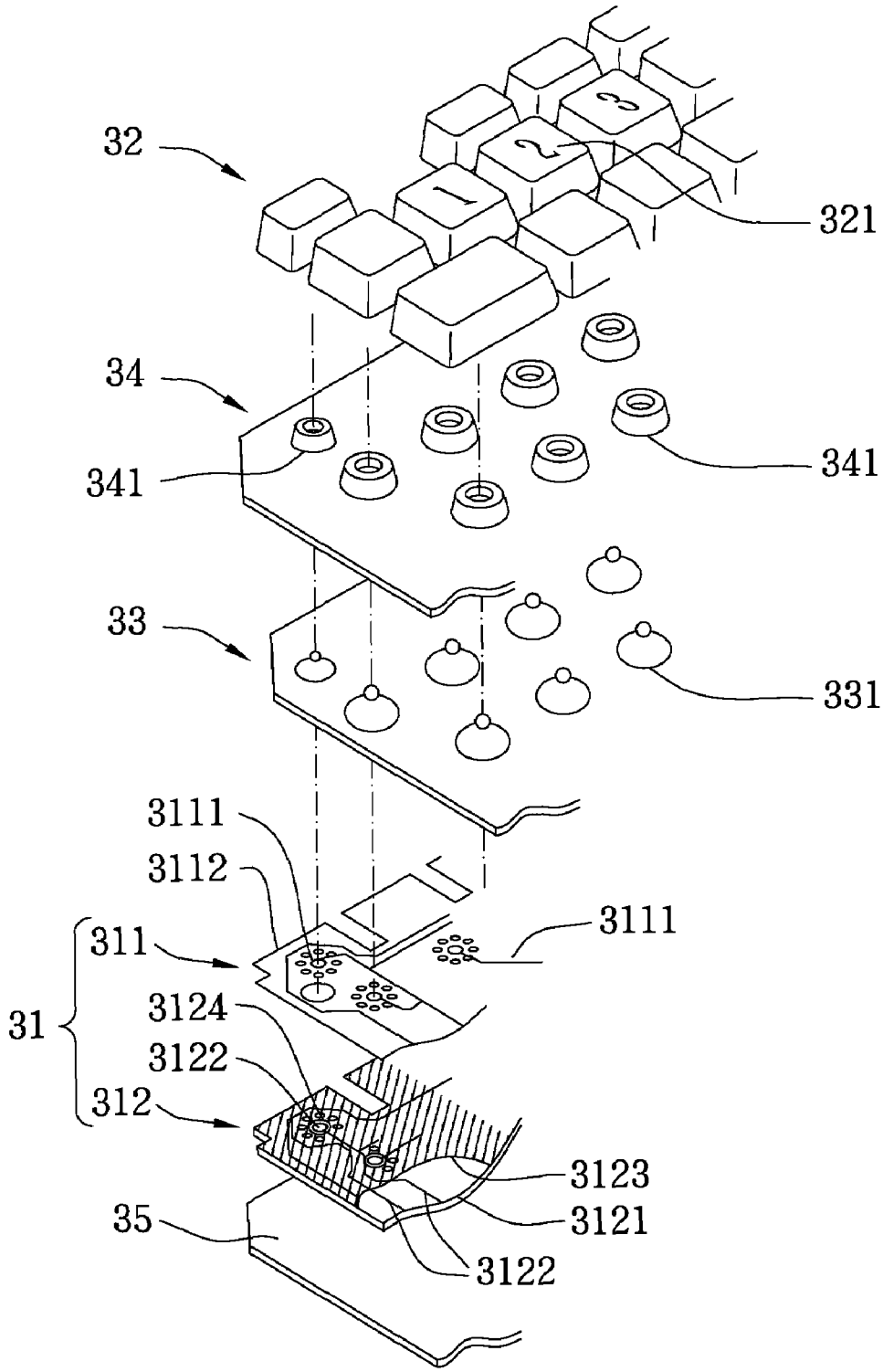
FIG. 3 is a partial exploded perspective view of an illuminating key membrane and a keyboard or a keypad using the same in accordance with the present invention.

FIG. 3 is an exploded diagram of an illuminating key membrane and a keyboard or a keypad using the same in accordance with the present invention. A plurality of key caps 32 are separately mounted on the seats 341 of an upper housing 34. Each of the key caps 32 is allowed to move down for a finite distance. Symbols are separately printed on the top surfaces of the key caps 32 to illustrate the functions or alphabet inputs of the key caps. Moreover, an elastomer layer 33 made from silicone or rubber is placed under the seats 341, and has a plurality of key actuators 331 whose positions correspond to the positions of the key caps 32. Because the key actuator 331 is very flexible, it can rapidly return to its original shape after a keystroke is released.

When the key actuator 331 is deformed after the pressing of the key cap 32, an illuminating membrane switch 31 beneath it is switched on. Meanwhile, an input signal corresponding to the key cap 32 is transmitted to a host through a cable (not shown). The illuminating membrane switch 31 comprises an upper membrane sheet 311 and a lower membrane sheet 312. The upper membrane sheet 311 comprises an insulating film 3112 and a plurality of upper lead wires 3111, and the lower membrane sheet 312 comprises an electroluminescent device 3121 and a plurality of lower lead wires 3122 disposed on the illuminating surface of the electroluminescent element 3121. The electroluminescent device 3121 can emit bright luminescence to the exterior of the illuminating membrane switch 31 through the upper membrane sheet 311. Furthermore, an insulating spacer layer 3123 protrudes on the illuminating surface of the electroluminescent device 3121 and serves as a spacer between the upper lead wires 3111 of the upper membrane sheet 311 and the lower lead wires 3122 of the lower membrane sheet 312. A metal plate 35 is placed beneath the illuminating membrane switch 31. The illuminating membrane switch 31 is sandwiched between the metal plate 35 and the upper housing 34.

Figure 4:
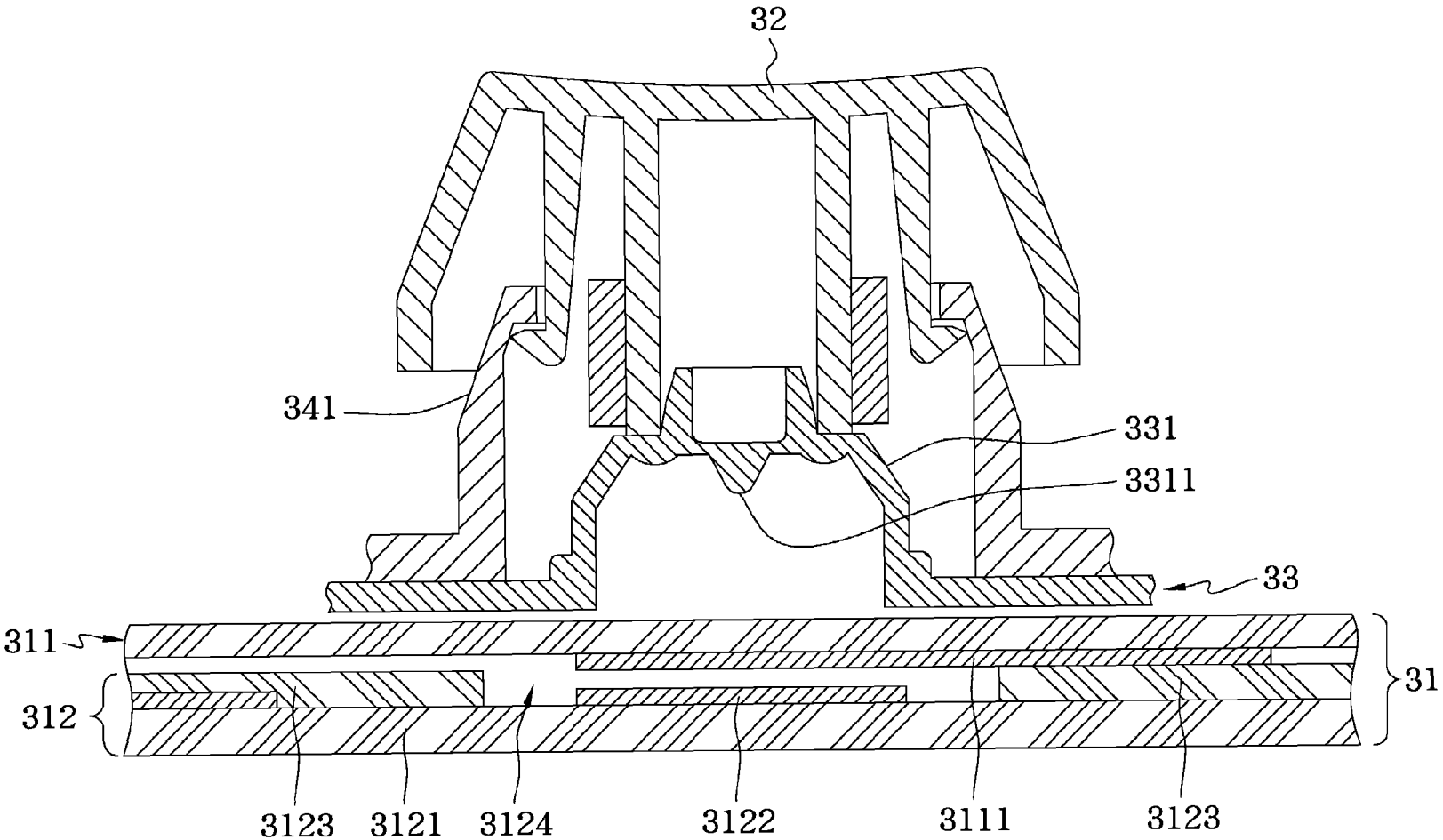
FIG. 4 is a cross-sectional view illustrating the keyboard of a personal computer to which an illuminating membrane switch is applied in accordance with the present invention.

FIG. 4 is a cross-sectional diagram illustrating the keyboard of a personal computer to which an illuminating membrane switch is applied in accordance with the present invention. Because the inner section of the key cap 32 and seat 341 are interlocked, it is difficult to separate the key cap 32 from the seat 341. The bottom of the key cap 32 is directly against the top surface of the key actuator 331. When the key cap 32 moves down after the pressing of a finger, the key actuator 331 is pressed to deform until the inner pressing portion 3311 forces the upper membrane sheet 311 and lower membrane sheet 312 to contact each other. Because the transparent insulating spacer layer 3123 has a plurality of openings 3124 right under the corresponding key caps 32, one of the upper lead wires 3111 of the upper membrane sheet 311 contacts one of the lower lead wires 3122 of the lower membrane sheet 312 through the opening 3124 after the downward pressing.

The upper lead wires 3111 are respectively formed on the insulating film 3112 to obtain the upper membrane sheet 311. Similarly, the lower lead wires 3122 are formed on the plastic surface of the electroluminescent device 3121 to obtain the lower membrane sheet 312. When the upper membrane sheet 311 reaches the lower membrane sheet 312, the upper lead wires 3111 and the lower lead wires 3122 contact each other as an electrical loop to generate a corresponding input signal. Generally, the wire patterns of the upper lead wires 3111 and the lower lead wires 3122 are respectively formed by printing silver pastes on the insulating film 3112 and the surface of the electroluminescent device 3121, and the edges of the upper membrane sheet 311 and lower membrane sheet 312 are sealed together to prevent the silver paste from oxidation or vulcanization. Moreover, the lower lead wires 3122 covered with the insulating spacer layer 3123 are well protected by the cover.

For the sake of illuminating the symbols 321 on the key caps 32 by means of the rays from the electroluminescent device 3121, transparent or translucent silicone is suitable for use as the elastomer layer 33. Furthermore, the key caps 32 and upper housing 34 are preferably made from transparent plastic or acrylic material. Similarly, the insulating film 3112 and the insulating spacer layer 3123 are from transparent plastic materials.

Figure 5:
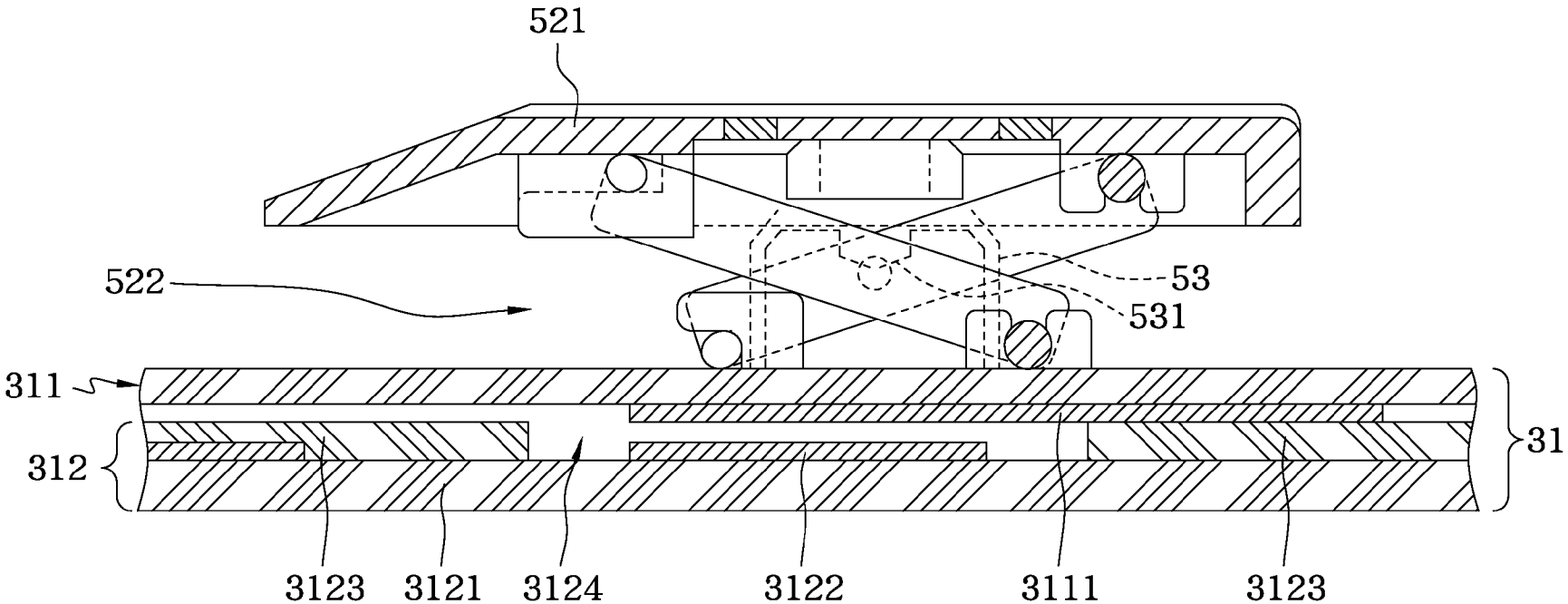
FIG. 5 is another cross-sectional view illustrating the keyboard of a notebook computer to which an illuminating membrane switch is applied in accordance with the present invention.

FIG. 5 is a cross-sectional diagram illustrating the keyboard of a notebook computer to which an illuminating membrane switch is applied in accordance with the present invention. The key cap 521 is fixed to a link mechanism 522 (like a so-called pantograph) in which a rubber spring 53 is placed. An illuminating membrane switch 31 is placed under the rubber spring 53. When the key cap 521 is moved down by the pressing of a finger, the rubber spring 53 is deformed till the inner pressing portion 531 forces the upper membrane sheet 311 and lower membrane sheet 312 to contact each other. The electroluminescent device 512 has a plurality of openings 5121 right under the corresponding key caps 32, and the upper lead wires 3111 of the upper membrane sheet 311 contact the lower lead wires 3122 of the lower membrane sheet 312 through the opening 3124 after the downward pressing.

Figure 6:
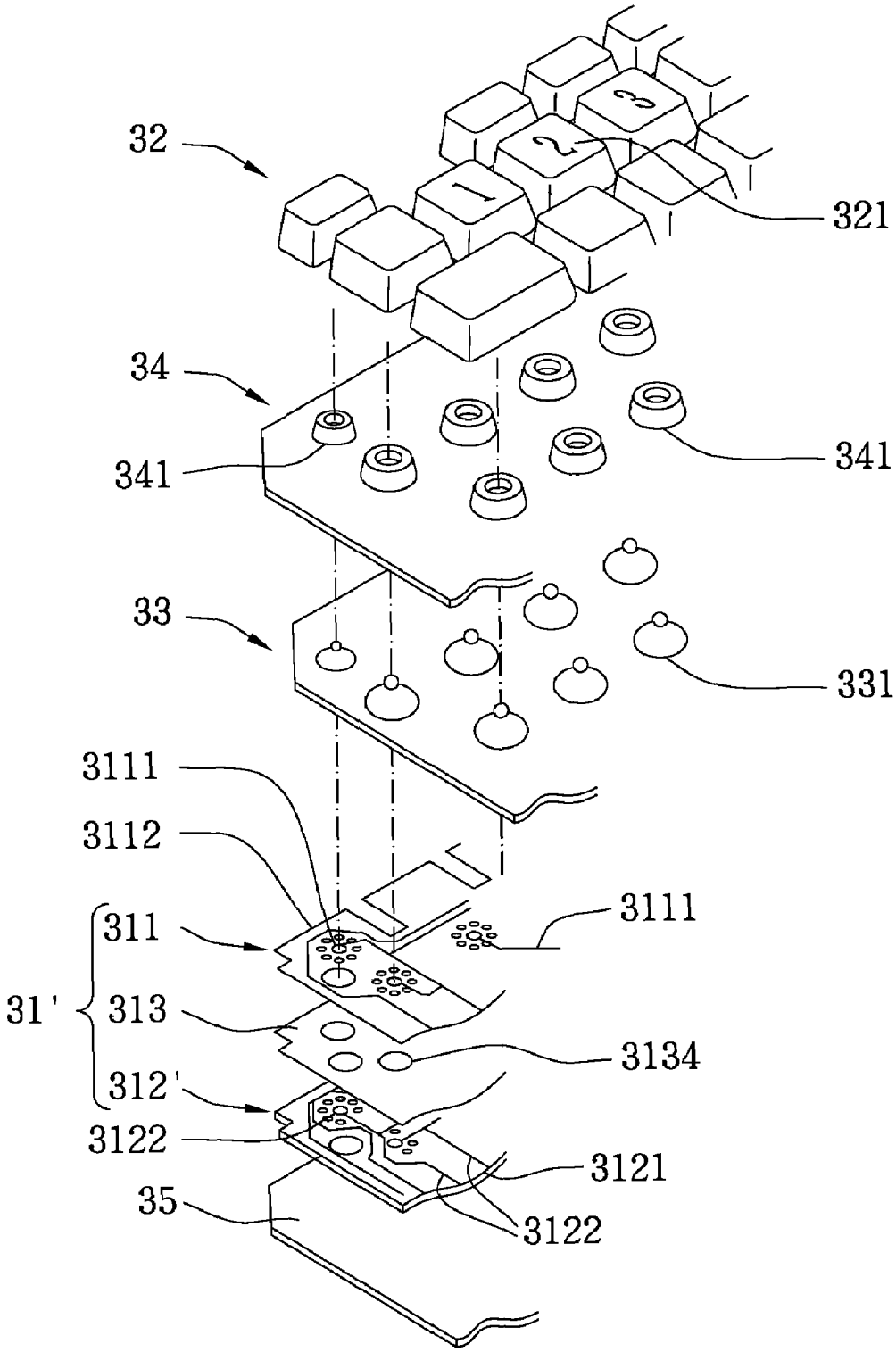
FIG. 6 is a partial exploded perspective view of an illuminating key membrane and a keyboard or a keypad using the same in accordance with another embodiment of the present invention.

FIG. 6 is an exploded diagram of an illuminating key membrane and a keyboard or a keypad using the same in accordance with another embodiment of the present invention. Compared with the illuminating membrane switch 31 in FIG. 3, the illuminating membrane switch 31' in FIG. 6 employs the spacer film 313 to replace the insulating spacer layer 3123, i.e., the lower membrane sheet 312' does not need the spacer directly disposed on its surface. The spacer film 313 is a transparent plastic material with a plurality of openings 3134. Therefore, when the key caps 32 are not pressed, the upper lead wires 3111 of the upper membrane sheet 311 and the lower lead wires 3122 of the lower membrane sheet 312' are isolated by the spacer film 313. However, downward force acts on the key caps 32, and one of the upper lead wires 3111 of the upper membrane sheet 311 reaches one of the lower lead wires 3122 of the lower membrane sheet 312' through the corresponding opening 3134.

The above-described embodiments of the present invention are intended to be illustrative only. Numerous alternative embodiments may be devised by persons skilled in the art without departing from the scope of the following claims.

We claim:

1. An illuminating membrane switch comprising:

an upper membrane sheet having an insulating film and a plurality of upper lead wires disposed on a surface of said insulating film;

a lower membrane sheet having an electroluminescent device and a plurality of lower lead wires, said electroluminescent device having an illuminating surface, said plurality of lower lead wires directly formed and overlaid on said illuminating surface;

an insulating spacer layer having a plurality of openings, said spacer layer interposed between said plurality of upper lead wires and said plurality of lower lead wires, said electroluminescent device positioned so as to emit rays through said upper membrane sheet, said plurality of upper lead wires selectively contacting said plurality of lower lead wires through said plurality of openings of said spacer layer.

2. The switch of claim 1, said insulating spacer layer being directly stacked on the illuminating surface.

3. The switch of claim 1, said insulating spacer layer being a separate spacer film.

4. The switch of claim 1, said insulating film being a transparent polymeric film.

5. The switch of claim 1, said insulating spacer layer being a transparent polymeric film.

6. The switch of claim 1, said plurality of upper lead wires being silver paste printed on said insulting film.

7. The switch of claim 1, said plurality of lower lead wires being silver paste printed on said illuminating surface of said electroluminescent device.

8. An illuminating keypad comprising:

an illuminating membrane switch having an upper membrane sheet and a lower membrane sheet, said upper membrane sheet having an insulating film and a plurality of upper lead wires disposed on a surface of said insulting film, said lower membrane sheet having an electroluminescent device and a plurality of lower lead wires directly formed and overlaid on an illuminating surface of said electroluminescent device, said illuminating surface having an insulating spacer layer with a plurality of openings, said insulating spacer layer positioned between said plurality of upper lead wires and said plurality of lower lead wires, said electroluminescent device positioned so as to emit rays through said upper membrane sheet, said plurality of upper lead wires arranged so as to selectively contact said plurality of lower lead wires through said plurality of openings of said spacer layer; and a plurality of key caps respectively positioned directly above said plurality of openings of said spacer layer and said upper membrane sheet, said plurality of key caps movable downwardly so as to press said plurality of upper lead wires so as to contact said plurality of lower wires.

9. The keypad of claim 8, further comprising:

an elastomer layer interposed between the key caps and the illuminating membrane switch, said elastomer layer having a plurality of key actuators, each of plurality of key actuators deformable so as to contact said upper membrane sheet when the key cap is pressed.

10. The keypad of claim 8, further comprising:

a link means positioned between the key cap and the illuminating membrane switch, said link means for limiting the key movement of the key cap for a finite distance along a vertical direction of said illuminating membrane switch.

11. The keypad of claim 8, further comprising:

an upper housing having a plurality of seats, said plurality of seats arranged respectively so as to limit a movement of said plurality of key caps for a finite distance along a vertical direction of said illuminating surface switch.

12. The keypad of claim 8, further comprising:

a metal plate positioned beneath said illuminating membrane switch.

* * * * *